United States Patent [19]

Place

[11] 3,940,729

[45] Feb. 24, 1976

[54] THERMOSTAT WITH HEAT CONDUCTOR

[75] Inventor: Donald E. Place, Mansfield, Ohio

[73] Assignee: Therm-O-Disc Incorporated, Mansfield, Ohio

[22] Filed: Dec. 18, 1974

[21] Appl. No.: 534,143

[52] U.S. Cl. ..... 337/377; 337/347; 337/372

[51] Int. Cl.[2] ..... H01H 37/32

[58] Field of Search ..... 337/94, 347, 349, 354, 337/355, 360, 371, 372, 377

[56] References Cited

UNITED STATES PATENTS

| | | | |
|---|---|---|---|
| 3,081,388 | 3/1963 | Cox | 337/354 |
| 3,139,500 | 6/1964 | Fallon et al. | 337/354 |
| 3,297,845 | 1/1967 | Mertler | 337/354 |
| 3,322,918 | 5/1967 | Ulanet | 337/94 |
| 3,735,319 | 5/1973 | Bletz | 337/347 |

*Primary Examiner*—Harold Broome

*Attorney, Agent, or Firm*—McNenny, Farrington, Pearne & Gordon

[57] ABSTRACT

An adjustable bimetal snap disc thermostat is disclosed which is provided with a disc seat having an elongated projection formed of deformable material, such as copper. Heat is conducted along the projection between the disc and a location remote from the thermostat so that the temperature of the disc is responsive, at least in part, to the temperature at such remote location.

14 Claims, 3 Drawing Figures

Fig. 1
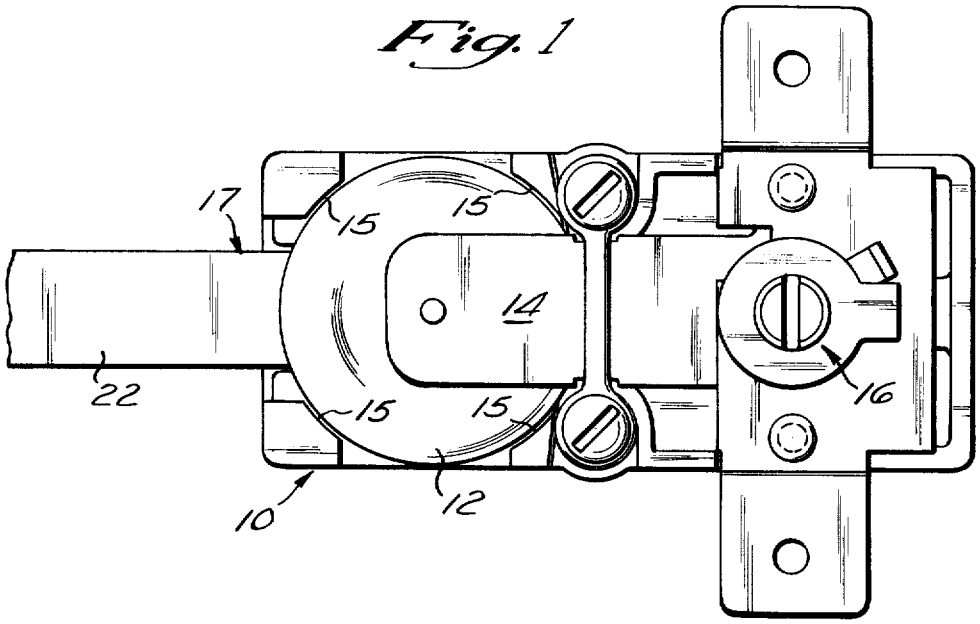
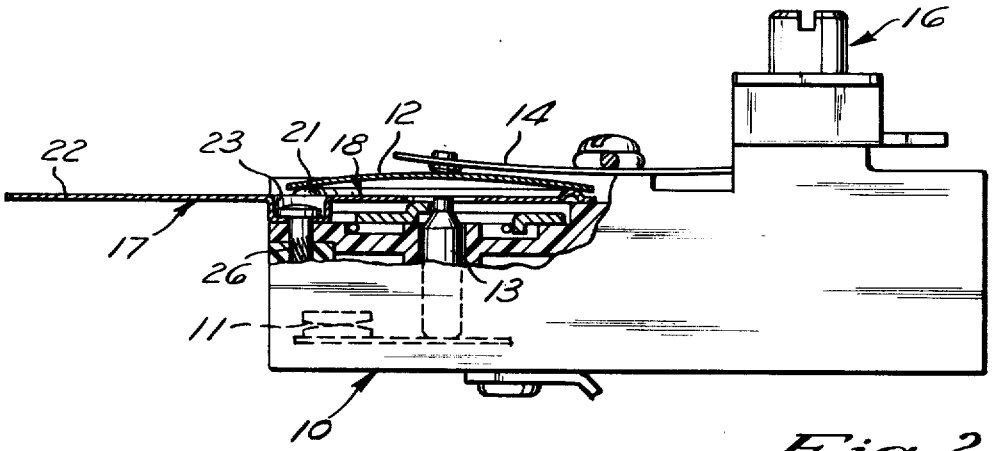
Fig. 2
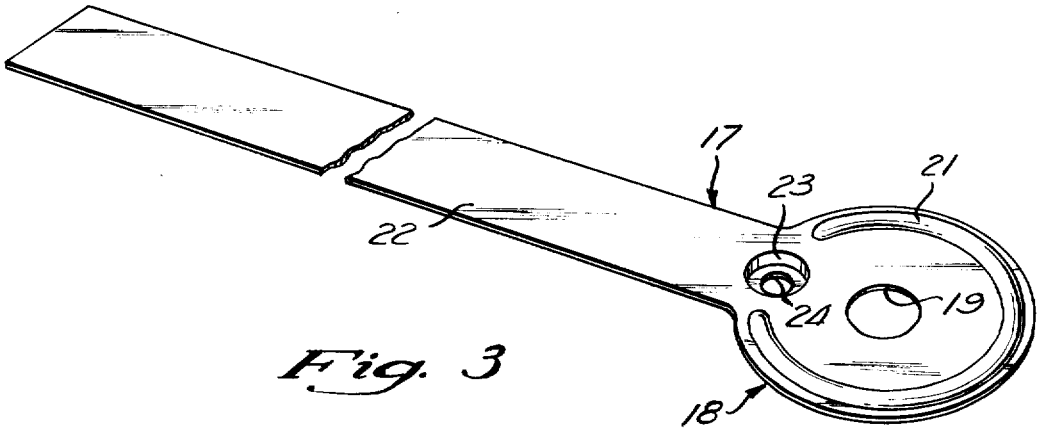
Fig. 3

THERMOSTAT WITH HEAT CONDUCTOR

BACKGROUND OF THE INVENTION

This invention relates generally to bimetal snap disc thermostats and more particularly to a novel and improved thermostat of such type having means making the thermostat responsive to temperature conditions existing at locations remote from such device.

PRIOR ART

In some instances, it is desirable to provide a thermostatic control which is principally affected by and responds to a temperature at a first location, but which also responds to a temperature at another location. For example, in room air-conditioners, the control thermostat is arranged to respond principally to the room temperature and to control the operation of the unit so as to maintain a selective room temperature. In such units, however, the evaporator coils sometimes accumulate frost which builds up and prevents proper air flow. When this occurs, it is desirable for the control thermostat to sense the frost condition and to terminate or modify the unit operation until the frost melts and is dissipated. In many room air-conditioners, a capillary-type thermostat has been used to control the unit. In such units it has been customary to position the capillary tube so that at least part of the tube is adjacent to the evaporator coil to sense a frost condition. In other instances, shrouds are provided so that the thermostat senses a selected temperature condition as illustrated in the U.S. Pat. No. 3,194,027.

The development of improved bimetal operated thermostats of both the blade and disc type, has resulted in an increased use of such thermostats in room air-conditioners and in other systems formerly dominated by capillary, tube-type thermostats.

Such bimetal thermostats have encountered some problems, since the bimetal has been normally sensitive only to the temperature existing in its immediate environment. In some instances, special shrouding is provided to insure that the bimetal responds to a particular desired temperature condition. Examples of particular shroud arrangements are illustrated in the U.S. Pat. Nos. 3,194,027 dated July 13, 1965; 3,293,875 dated Dec. 27, 1966; 3,546,652 dated Dec. 8, 1970; and 3,623,335 dated Nov. 30, 1971.

It has also been proposed to provide a heat conductive wire connected to the stationary end of a cantilever mounted bimetal blade-type thermostat, to provide sensitivity to a location remote from the thermostat.

SUMMARY OF THE INVENTION

In accordance with the illustrated embodiment of this invention, an adjustable bimetal snap disc thermostat is provided with a disc seat formed of heat conductive material, having a projection which can be positioned to cause the disc to respond at least in part, to a temperature at a remote location.

The seat and projection are formed of a relatively ductile material having good heat conducting properties, such as copper. The disc seat portion is formed with a raised annular extending rib which engages the disc at its periphery for good conductive heat transfer. Further, the adjacent side of the disc is adjacent to the disc seat so convection and radiation heat transfer also occurs.

The thickness and the width of the projection is selected to provide a heat flow path of sufficient section to produce the desired disc sensitivity to the temperature at the remote location.

A rivet is located in the zone between the projection and the disc seat so that the disc seat position is maintained even when the projection is bent to properly locate the projection. The rivet head is located in a socket formed in the heat conductor, which cooperates with the ribs to prevent the bending of the projection from moving or distorting the disc seat. Movement or distortion of the disc seat could adversely affect the calibration of the thermostat.

BRIEF DESCRIPTION OF THE DRAWINGS

FIG. 1 is a plan view of an adjustable bimetal snap disc thermostat in accordance with the present invention;

FIG. 2 is a side elevation partially in section of the thermostat illustrated in FIG. 1; and, FIG. 3 is a perspective view of the preferred heat conductor which functions to transfer heat between the bimetal snap disc and a location remote from the thermostat.

DETAILED DESCRIPTION OF THE DRAWINGS

In the illustrated embodiment of this invention, an adjustable disc thermostat of the type disclosed in detail in the U.S. Pat. No. 3,735,319, is provided with the present invention. Reference should be made to such patent for a more detailed description of the thermostat, per se, and the disclosure of such patent is incorporated herein by reference.

Referring now to the drawings, the thermostat includes a body assembly 10 within which is mounted a switch 11 (illustrated in phantom in FIG. 2). A bimetal snap disc 12 is movable with snap action between its two positions of stability, and is connected to operate the switch 11 by means of a bumper 13. In this embodiment a leaf spring 14 applies a spring force to the disc 12 in such a manner that adjustment of the spring force applied by the leaf spring 14 permits adjustment of the operating temperature of the disc. An adjusting mechanism 16 permits the adjustment of the spring force of the leaf spring 14 applied to the snap disc 12.

The snap disc 12 is supported on one side by a disc seat member 17 and is laterally positioned by projections 15, formed in the body assembly 10. Referring to FIG. 3, the disc seat member provides a disc seat portion 18 of generally circular shape and having a diameter substantially equal to the diameter of the bimetal snap disc. A central opening 19 is provided in the seat portion 18 through which the bumper 13 projects with clearance. A raised rib 21 of annular shape, extends around the seat portion 18, substantially adjacent to its periphery. It is against the rib 21 that the periphery of the disc 12 is seated. The seat member 17 is also provided with an elongated projection 22 which extends from the thermostat proper and is adapted to be positioned adjacent to a location remote from the thermostat at which the temperature is to be sensed. For example, in a room air-conditioner, the projection 22 extends to and is positioned adjacent to the evaporator coil of the air-conditioner so that its temperature will be affected by the condition of the evaporator. For example, if excessive frost builds up on the evaporator, the air flow through the evaporator is blocked and the temperature of the evaporator surface drops to abnormal values. The projection 22 is normally positioned to sense such abnormal temperature conditions occurring when excessive frost occurs on the evaporator.

Located between the projection 22 and the seat portion 18 is an offset stiffening section 23 formed with an opening 24 to receive a rivet-like fastener 26. The fastener projects through the opening 26 and secures the projection to the body assembly 10 to securely mount the disc seat member 17 on the body assembly. Because of the stiffening provided by the stiffening section 23, any movement of the various portions of the projection 22 does not result in significant distortion or movement of the seat portion 18. Further, the diameter of the seat portion 18 is selected so that the body projections 15 cooperate with the rivet to fix the location of the seat portion within the body. If the seat portion 18 were allowed to move when the projection is bent to locate it with respect to the evaporator, the calibration of the thermostat would be changed. It is, therefore, important to arrange the structure so that the bending movement of the projection does not result in any significant movement of the disc seat portion 18.

It is preferable to form the seat member 17 of a material which has good heat transfer properties, and also to utilize a material which is sufficiently soft to allow the projection 22 to be bent or moved to the desired location. A soft copper is therefore the preferred material for forming the seat member, although other suitable materials may be utilized. In the illustrated embodiment, the disc seat member 17 is formed as a stamping from sheet copper. The thickness of the disc seat member and the width of the projection 22 is selected to provide sufficient heat flow between the seat portion and the extremity of the projection to produce the required modification of the temperature of the disc 17. In instances where the projection must be somewhat longer, the thickness can be increased or the width of the projection can be increased to maintain the desired heat flow characteristics.

Because of the heat conducting flow path along the projection 22, the temperature of the disc 12 is determined at least in part by the temperature of the projection 22. Of course since the disc 12 is also exposed to the air in the immediate environment, its temperature also responds to the environmental air temperature at the disc.

In a normal air-conditioning installation, the thermostat is positioned so that the disc 12 is sensitive to the air temperature in the room being air-conditioned. Usually the disc is arranged so that room air is drawn in over the disc as it flows into the air-conditioner. Consequently, the disc is sensitive to room air temperature and is connected to control the operation of the air-conditioner to maintain a desired room air temperature. If desired, shrouds may be provided to produce a desired flow of air over the disc. The temperature response resulting from a temperature sensed by the projection is usually not dominant. However, in the event of frosting, or the like, of the evaporator, the projection 22 is cooled to a lower than normal temperature and heat flows along the projection from the disc to the area of the evaporator. Under such condition the temperature of the disc is affected in part by the temperature at the evaporator and the operation of the air-conditioner is modified to allow the automatic correction of the frost condition. Therefore, with the present invention, a bimetal snap disc thermostat is provided in which the disc responds, at least in part, to a temperature remote from the thermostat.

In the particular embodiment illustrated, the leaf spring 14 maintains tight engagement between the disc periphery and the rib 21. Consequently, a good and direct conductive heat flow path is assured between the disc 12 and the seat member 17. The rib functions to stiffen the seat portion and also to provide the central clearance required when the disc snaps through from the illustrated position to its opposite position of stability. Further, the fact that the disc and the seat portion are substantially co-extensive provides good temperature response in the disc to the temperature of the seat.

It should be understood that even though the thermostat in accordance with the present invention is described primarily for use in air-conditioning units or the like, that the present invention is equally applicable to other installations where a bimetal snap disc thermostat is intended to be responsive, at least in part, to a temperature condition remote from the thermostat.

Although a preferred embodiment of this invention is illustrated, it is to be understood that various modifications and rearrangements may be resorted to without departing from the scope of the invention disclosed and claimed.

What is claimed is:

1. A thermostat comprising switch means, a bimetal snap disc movable with snap action upon reaching operating temperatures and connected to operate said switch means, and disc seat means formed of a conductor of heat material engaging and locating said disc, said disc seat means being provided with a flexible elongated projection extending from said thermostat permitting said projection to be deformed to extend to a desired location spaced from said body, said disc seat means operating to conduct heat along said projection between said disc and said location spaced from said body and disc so that the temperature of said disc is determined at least in part by the temperature at said location and mounting means connecting said conductor to said body preventing movement of said projection from causing any substantial change in the calibration of said disc.

2. A thermostat as set forth in claim 1 wherein said seat means is provided with an annular portion engagable with said disc along substantially its entire periphery.

3. A thermostat as set forth in claim 2 wherein said seat means includes a circular portion substantially coaxial with said disc, and a raised annular rib engaging the periphery of said disc.

4. A thermostat as set forth in claim 3 wherein said seat means includes a unitary element formed of sheet material and said projection has sufficient cross sections to provide the required heat conducting capacity.

5. A thermostat as set forth in claim 4 wherein said material is copper or the like.

6. A thermostat as set forth in claim 4 wherein said thermostat is provided with a base assembly, and said mounting means includes a fastener securing said seat means to said base assembly.

7. A thermostat comprising switch means, a bimetal snap disc movable with snap action upon reaching operating temperatures and connected to operate said switch means, and disc seat means formed of a conductor of heat material engaging and locating said disc, said disc seat means being provided with an elongated projection extending from said thermostat, said disc seat means operating to conduct heat along said projection between said disc and a location spaced from said disc so that the temperature of said disc is determined at least in part by the temperature at said location, adjusting means for changing the operating temperature of said disc adjusting means tightly pressing said disc against said disc seat means.

8. A bimetal snap disc thermostat comprising a body, switch means on said body, a bimetal snap disc on said body operating said switch means upon reaching operating temperatures, and a unitary heat conductor formed of ductile material and having a deformable elongated projection extending from said body and being adapted to be positioned at a location remote from said body, said heat conductor engaging said disc for transfer of heat between said disc and said remote location, and means connecting said heat conductor to said body and preventing movement of said projection from causing any substantial change in the calibration of said disc.

9. A bimetal snap disc thermostat as set forth in claim 8 wherein said heat conductor engages said disc adjacent to the edge thereof.

10. A bimetal snap disc thermostat as set forth in claim 9 wherein said heat conductor engages said disc along substantially the entire periphery thereof, and spring means resiliently maintains said engagement between said disc and said heat conductor.

11. A thermostat comprising switch means, a bimetal snap disc movable with snap action upon reaching operating temperatures and connected to operate said switch means, and disc seat means formed of a conductor of heat material engaging and locating said disc, said disc seat means being provided with an elongated projection extending from said thermostat, said disc seat means operating to conduct heat along said projection between said disc and a location spaced from said disc so that the temperature of said disc is determined at least in part by the temperature at said location, mounting means preventing movement of said projection from causing any substantial change in the calibration of said disc, said seat means being provided with an annular portion engageable with said disc along substantially its entire periphery, said seat means including a circular portion substantially coaxial with said disc, and a raised annular rib engaging the periphery of said disc, said seat means being a unitary element formed of sheet material and said projection having sufficient cross sections to provide the required heat conducting capacity, said thermostat being provided with a base assembly and said mounting means including a fastener securing said seat means to said base assembly, said unitary element being formed with a stiffening section between said projection and said circular portion, and said mounting means securing said stiffening section to said base.

12. A thermostat as set forth in claim 11 wherein said stiffening section includes a lateral projection formed in said unitary element at the junction between said circular portion and said projection, and said mounting means includes a fastener extending through said lateral projection.

13. A thermostat as set forth in claim 11 wherein adjusting means are provided to change the operating temperatures of said disc.

14. A thermostat as set forth in claim 13 wherein said adjusting means tightly presses said disc against said rib.

* * * * *